US006061878A

United States Patent [19]

Patelli et al.

[11] Patent Number: 6,061,878

[45] Date of Patent: May 16, 2000

[54] FEEDING DEVICE FOR FIBER MATS IN FLAT CARDERS

[75] Inventors: Silvano Patelli; Giovanni Battista Pasini, both of Palazzolo Sull'Oglio, Italy

[73] Assignee: Fratelli Marozli & C. S.p.A., Bergamo, Italy

[21] Appl. No.: 09/195,756

[22] Filed: Nov. 18, 1998

[30] Foreign Application Priority Data

Nov. 18, 1997 [IT] Italy ..... MI97A2558

[51] Int. Cl.[7] ..... D01G 15/40

[52] U.S. Cl. ..... 19/105; 19/65 A; 19/98

[58] Field of Search ..... 19/64.5, 65 A, 19/98, 99, 100, 101, 105

[56] References Cited

U.S. PATENT DOCUMENTS

| | | | |
|---|---|---|---|
| 3,911,696 | 10/1975 | Buckholtz et al. | 66/9 B |
| 4,345,356 | 8/1982 | Handschuch et al. | 19/105 |
| 4,795,335 | 1/1989 | Farrington et al. . | |
| 5,862,573 | 1/1999 | Leifeld | 19/105 |

FOREIGN PATENT DOCUMENTS

| | | | |
|---|---|---|---|
| 0431483 | 6/1991 | European Pat. Off. . | |
| 2577246 | 8/1986 | France . | |
| 521832 | 7/1993 | France | 19/98 |
| 63-099330 | 4/1988 | Japan . | |
| 688 045 A5 | 4/1997 | Switzerland . | |

*Primary Examiner*—John J. Calvert
*Assistant Examiner*—Gary L. Welch
*Attorney, Agent, or Firm*—Kramer Levin Naftalis & Frankel LLP

[57] ABSTRACT

Flat carder in which the main carding drum receives the fibers from a multiple number of briseurs operating in parallel to feed the main carding drum at different points. Each briseur or opening cylinder is equipped and actuated independently from the other.

8 Claims, 3 Drawing Sheets

FEEDING DEVICE FOR FIBER MATS IN FLAT CARDERS

This invention refers to flat carders in which the fibrous material is processed in a thin layer by a series of surfaces equipped with a multiple number of prongs of various shape, inclination and rigidity kept in a relative motion to each other, whereby the fibrous material is opened up to form individual fibers, the smallest dirt particles—such as the wastes and snarls or "neps"—are eliminated, and the fibers are commingled to form a belt of untwisted fibers, to be conveyed to further processing stages.

Figure 1:
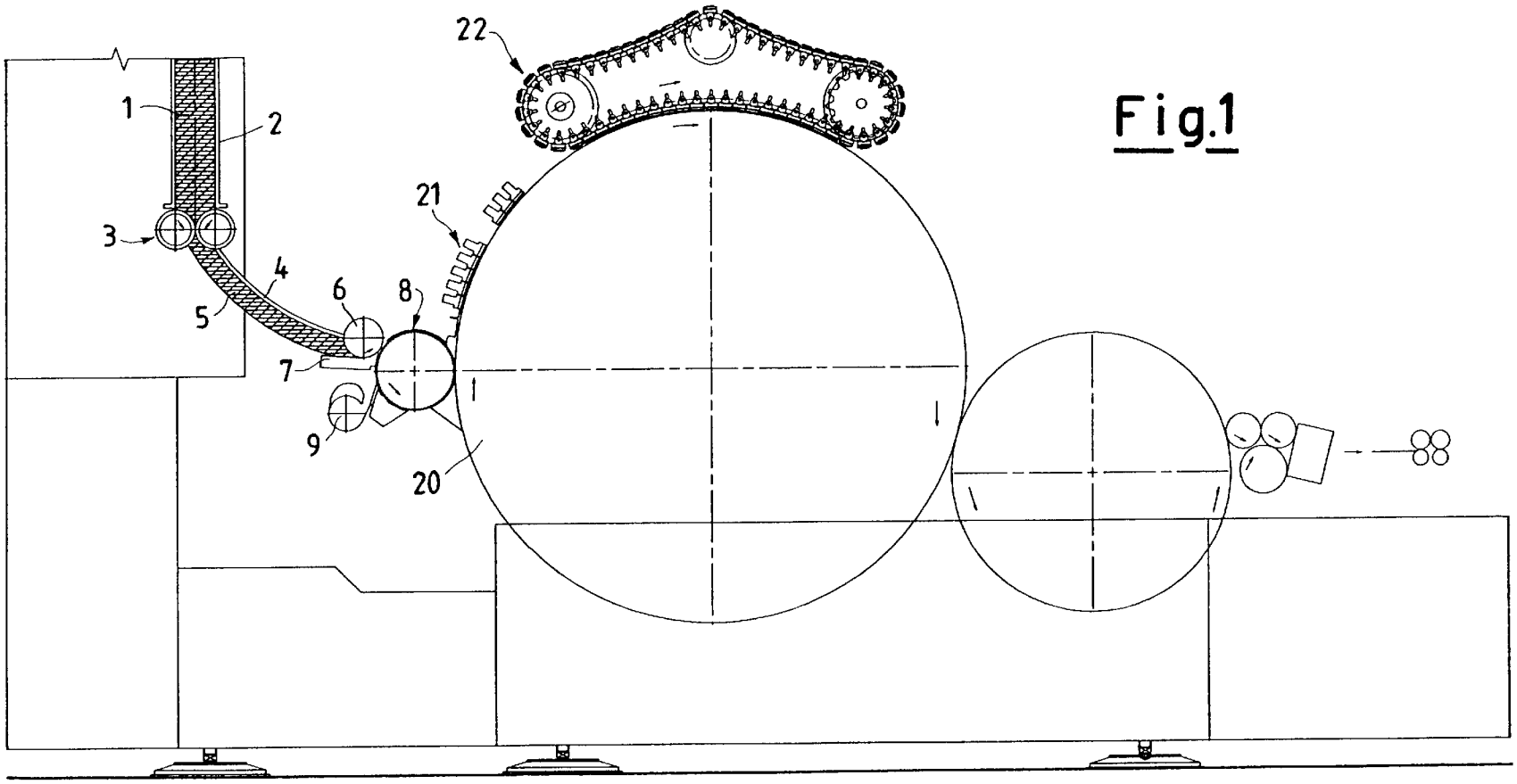

In its most general outlines, the cotton carding operation occurs in the following main phases, illustrated in FIG. 1. The raw material 1 constituted by fibers in a flock form is accumulated in the terminal part 2 of a fiber storage bin, in which its density is regulated and controlled by pneumatic action. At the bottom of the bin, a discharging system based on cylinders or lobe rollers 3 rotating at a controlled speed to regulate the fiber carrying capacity discharges the fibers to a chute 4 feeding the fibers to the carder in form of a mat 5. The machine is equipped with a feeding roller 6 which compresses and controls the mat against the feeding table 7 and supplies a section to the opening cylinder 8, normally known as "briseur".

This cylinder is fitted with a clothing or prongs tilted in the direction of rotation and driven at a considerable rotary speed. The mat of fibers fed to the briseur is thus coarsely combed and spread out on the opening cylinder, in a layer thinner than that 5 originally present on the chute 4. During its rotation, as shown in FIG. 1 in a counterclockwise direction, the layer of fibers encounters one or several opening and purifying devices constituted by fitted segments and knives designed to remove the impurities, as will be illustrated in greater detail below. These impurities are removed by suction nozzles 9, placed opposite the face of the knife on the outside of the briseur. The knives and fitted segments are mounted on supports and equipped with adjusting devices not shown in the Figure for simplicity, designed to position them with precision with respect to the teeth of the clothing of the briseur cylinder, depending on the nature and the conditions of the fibers under processing.

The main carder drum 20 is downstream of the briseur. In general this main drum 20 is driven at a slower rotary speed than the briseur 8, but has a higher peripheral velocity due to its much larger diameter. The prongs of the drum 20 are tilted in the direction of motion and remove, opposite the nearest generatrix profiles between the briseur 8 and the drum 20, the fibers from the clothed surface of the briseur cylinder. The drum's peripheral velocity indicatively falls within the range of 1,000 and 2,500 m/min and is 20% to 50% greater than that of the briseur feeding it with the fibers.

Around its outer circumference the drum 20 carries the so-called carding flats involved in the carding process. These may be of a fixed type 21, mobile type 22 or of a rotating type. They act in combination with the drum fittings to card the fibers supplied by the briseur, which are processed on the carder drum and then removed from the carder by some discharging and stripping cylinders.

The function of the opening cylinder or briseur 8 is essentially that of performing the first combing and rough disentangling of the fibers. This opening process is accompanied by a substantial purifying effect of the fibers distributed in this manner. Considering the briseur's rotary speed, which is generally higher than that of the drum, it can be seen that the action of the centrifugal force on the dust, the lumps, the short fibers, snarls and the like is more effective on the briseur than on the subsequent main drum 20. However, the centrifugal effect is limited by the need to contain the loss of the prized portion of long fibers which must not be allowed to escape the grasp of the briseur's fitting.

In order to achieve a maximum purifying effect to the benefit of the carded fibers' quality, it is therefore necessary to limit the thickness of the layer of distributed fibers carried on the briseur. This layer acts in fact as a filter and retainer while releasing the particles of dirt entrapped inside the layer, depending on its thickness. It follows that the need for carded fiber quality demands limiting the thickness of the layer and therefore the flow rate of the fiber fed to the briseur and the productivity of the entire carding machine.

In order to boost the cleaning and initial combing action of the fibers, it was suggested to perform the first opening operation by a system of two briseurs set in series and operating at increasing speeds. The second opening cylinder or briseur works with the aid of organs similar to those of the first briseur, but its peripheral velocity is substantially higher than that of the first cylinder, and the teeth of its fittings remove the fibers from the first briseur, before conveying them to the main carder drum.

The fibers are further combed and distributed over the second opening drum in a layer thinner than that on the first briseur. The second briseur operates at higher speeds and exhibits a greater centrifugal effect, but the improved purifying effect is also due to the fact that in transferring from the first to the second briseur the fiber mat is substantially turned upside down. This is due to the fact that the fibers first found in the innermost layer are later encountered on the outermost surface layer of the second briseur: the innermost portion of dirt, which encounters the greatest releasing difficulties in the first briseur is easily released in the second. The second briseur therefore passes the fibers on to the subsequent main carder drum 20.

More in particular, this invention refers to a system of opening cylinders or briseurs of a new concept, directed to improve the preparation of the fibers fed to the main carding drum, thus achieving both a better purifying action, a greater intermingling of the fibers and a better quality and uniformity of the carding product.

The process is in its basic features is a flat carder in which the main carding drum (20) is fed by a briseur or opening cylinder and the fibers are already roughly distributed and purified in a layer adherent to its clothing, characterized in that it is equipped with a multiple number of briseurs (30*a, b*) operating in parallel to feed the fibers processed by them to different points of the main carding drum.

In order to illustrate the characteristics and advantages of this invention with greater clarity, it will be described with reference to some of its typical embodiments shown in FIGS. 2, 3 and 3A for exemplifying and non-limiting purposes.

Figure 2:
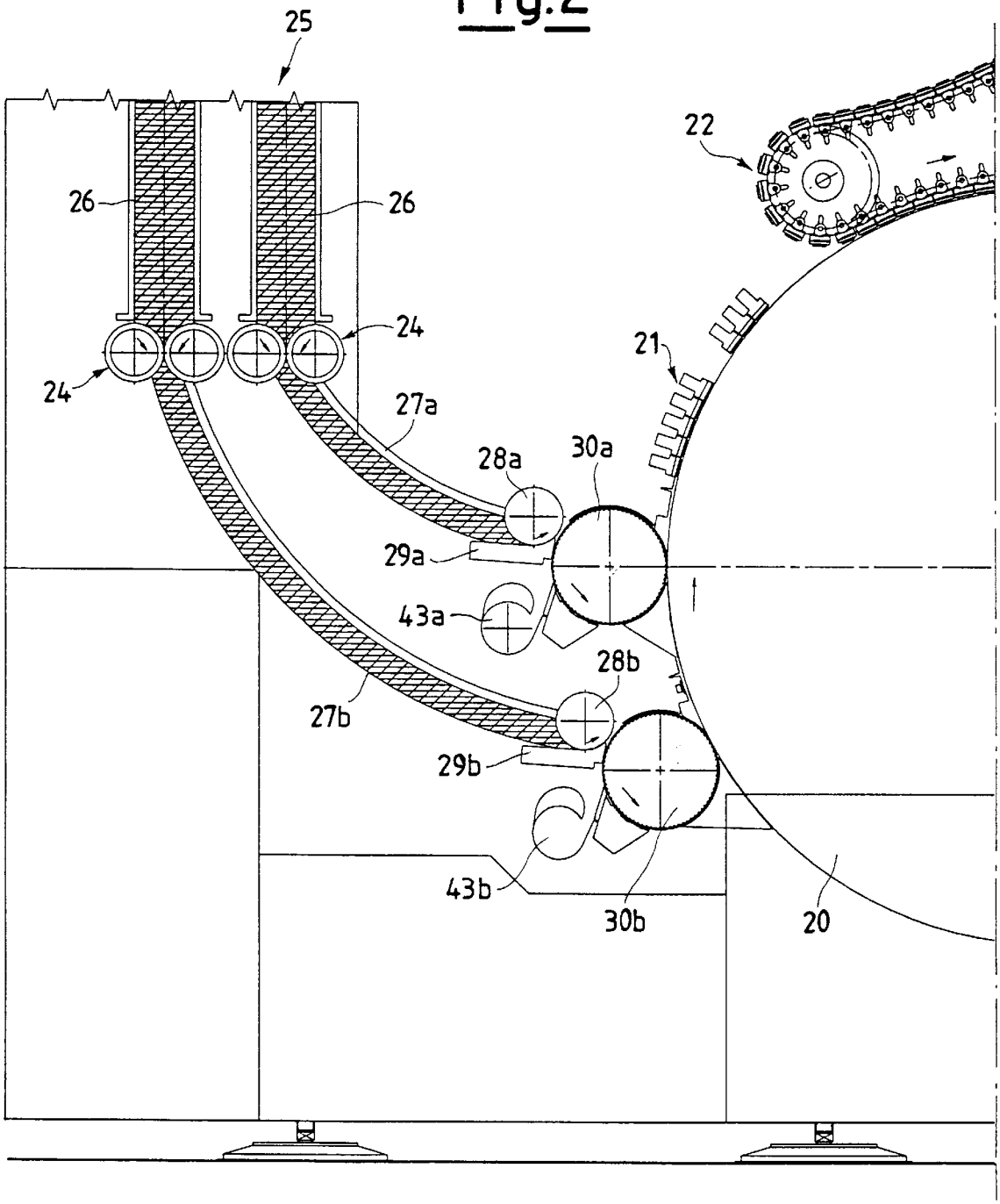
Figure 3:
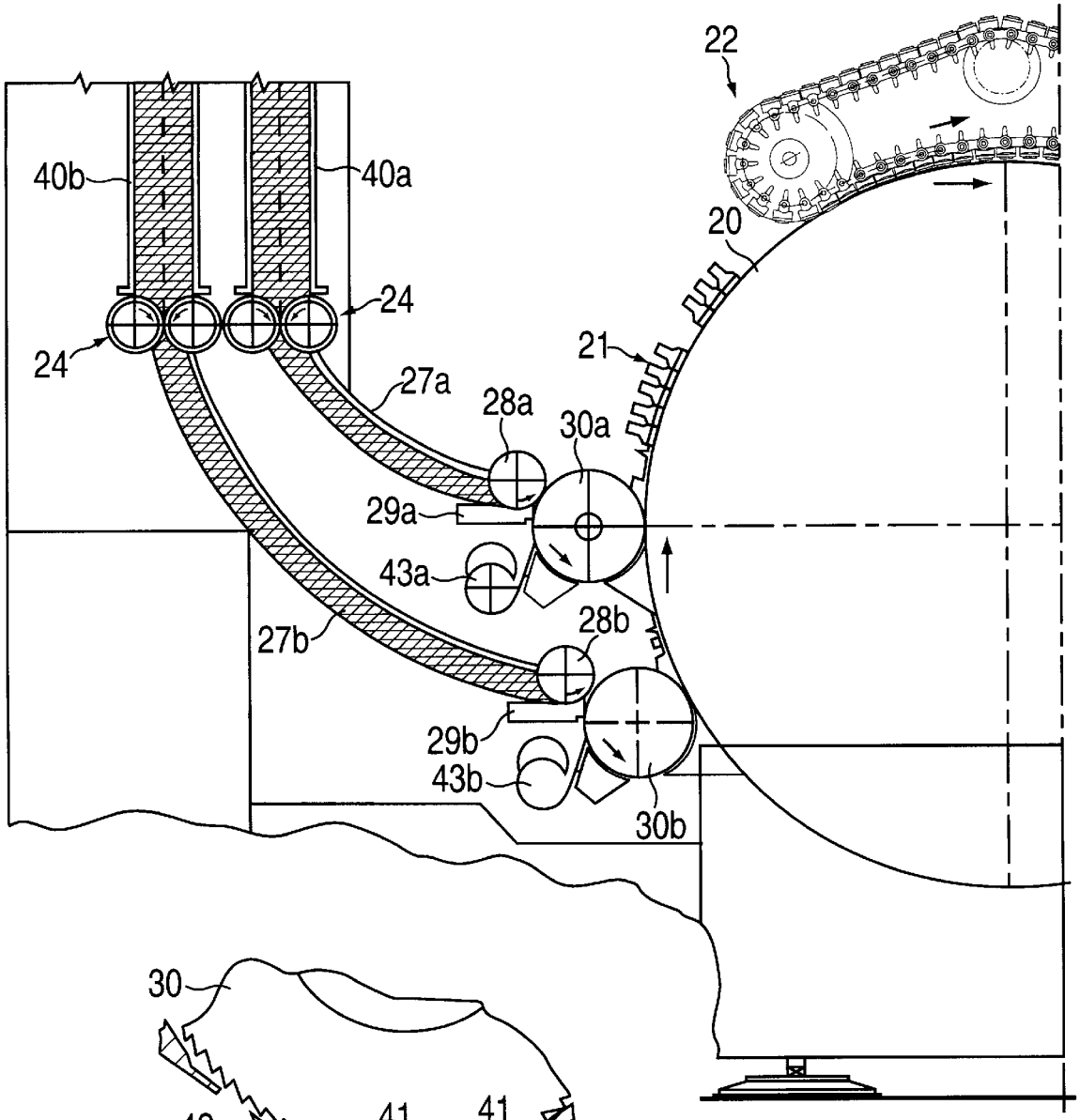
Figure 3A:
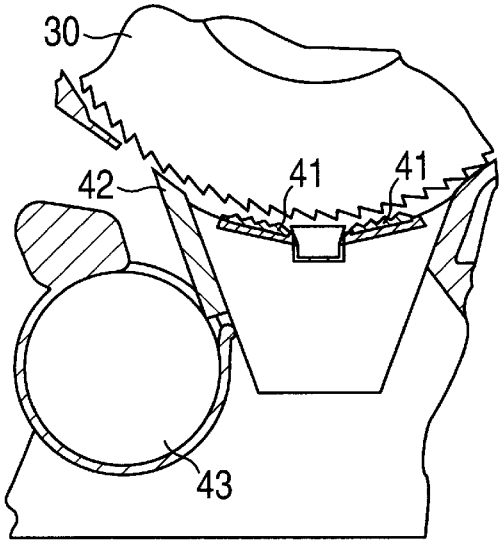

The embodiments in FIGS. 2, 3 and 3A show an enlarged view of the carder's feeding area, up to the point where the fibers are transferred to the main carding drum 20.

The storage unit of the flock fiber feeding system is constituted by a multiple number of fiber outlets, provided by pairs of discharge cylinders or rotating lobe rollers 24, and may be formed by several discharges from the same bin containing the fibers of the same batch or from different bins containing fibers of different batches or qualities. FIGS. 2, 3 and 3A illustrate an embodiment providing two feeds from two outlets of the feed storage system. FIG. 2 shows a storage embodiment in which a single bin 25 fed with the same batch of fibers is constituted of various vertical compartments 26 set side by side, for instance containing fibers drawn from the bales at different moments and/or levels. In this manner, a multiple level bin may equalize the batch by performing a function equivalent to that of the structure of a fiber mixing device according to the Italian patent no. 1.243.895 of the Applicant. Each compartment 26 is equipped with its own pair of discharge cylinders 24 and allows feeding the carder with a mat of fibers which are not merely purer but also of more uniform quality, as it provides for a mixture of fibers drawn at different moments or found at different levels of the raw bales. Even when processing fibers of an identical quality at the two outlets, the device according to the invention is advantageous for the purposes of improving the precision and regularity of the basis weight of the fiber mats fed to the carding machine, and of the count and of uniformity of the sliver produced by the carding machine.

This storage system feeds the carder with several separate flows. In FIG. 2 the feeding system includes the chutes 27*a, b* which in turn supply the fibers in form of a mat to the roller system 28*a, b* and the feeding table 29*a, b* of two briseurs 30*a* and 30*b,* which come to operate in parallel and in turn to feed the main carder drum 20 at different points.

On the other hand, FIGS. 3 and 3A shows a storage system based on a multiple number of bins 40*a, b* exemplified in the figure in the number of two but available in a greater number, fed with various batches of fibers. Each bin 40 is equipped with a drawing system similar to that shown in FIG. 2 based on its pair of discharging cylinders 24 and allows feeding the carder with mat of fibers from its batch, depending on the fiber carrying capacity and the specific processing required by the batch.

Especially in the case of the embodiment shown in FIGS. 3 and 3A it is important to note the independent action of the two briseurs, which are tied up only to operate at a peripheral velocity below that of the main carding drum they must supply with their layer of fibers, while all other operating and equipment parameters can be adapted to the particular type of fibers to be processed. Particularly in the case of different batches of fibers, the briseurs 30*a* and 30*b* according to this invention are capable of working independently. They are supplied with the components and equipped with an actuating system to operate independently from each other. They are both driven at the desired speed and fed with mats of fibers at the carrying capacity designed to obtain the proper mixture and the desired quality.

Depending on the type and quality of the fibers for which it is designed, each of the two briseurs 30*a, b* is equipped with a tailor-made clothing, meaning a set of more or less numerous teeth or prongs, of appropriate shape and size and more or less aggressive form, so as to achieve a greater opening and purifying action on the fibers, and to limit fiber breakage and the occurrence of the so-called "neps" meaning snarls of fibers, and to thereby guarantee a greater performance and longer life of the clothing, depending on the type of fiber it is destined to process.

The same degree of regulating freedom is adopted for the type, number and adjustment of the components of the auxiliary system for the cleaning and disentangling of the fibers, which is essentially achieved by using the clothing segments 41, the knives 42 and the suction nozzles 43 shown in FIGS. 3 and 3A always in relation to the type and quality of the fibers each of the two briseurs 30*a, b* is designed for. In particular, the clothings of the segment 41 may, like those of its briseur, be chosen to have a density, inclination, shape and size appropriate to the particular type of fiber to be processed on the same.

The compositions of the mixture between the two feeds of the briseurs may be achieved by adjusting the carrying capacity of each fiber mat issued by the discharging cylinders 24 and presented to the feeding roller 28*a, b* of each briseur. The overall basis weight of the fiber mat in the carding process will turn out to be more uniform.

In the embodiment of FIG. 2 the presence of the double briseur working in parallel on the same batch of fibers allows obtaining a product with a more uniform composition and a better control of the basis weight of the mats.

On the other hand, in the case of FIGS. 3 and 3A in which batches of various fibers are processed from two separate stocks, this invention presents a further advantage; the delivery of the two batches of fibers to different points of the carding drum in fact allows arranging the material on its clothing in the desired order. The different positioning of the fibrous material with respect to the roughness of the clothing according to its characteristics allows exerting a more or less aggressive action on the fibers of the two batches, depending on the requirements.

What is claimed is:

1. A flat carding machine comprising at least two opening means operating in parallel, said opening means each including a feeding means and an opening cylinder, wherein each of said opening means has an individual supply source of fiber and each opening cylinder removes impurities from the fibers, and wherein each of said at least two opening means deposits fibers to a respective position on a main carding cylinder.

2. The flat carding machine according to claim 9 wherein each opening cylinder is independently controllable.

3. The flat carding machine according to claim 2, wherein each opening cylinder is equipped with tailor-made clothing comprising a plurality of teeth.

4. The flat carding machine according to claim 3 wherein the plurality of teeth has a shape and size appropriate for the fibers the opening cylinder is to process.

5. The flat carding machine according to claim 2, wherein each opening cylinder is equipped with an auxiliary fiber opening and purifying system, comprising clothing segments, knives, and suction nozzles.

6. The flat carding machine according to claim 5 wherein the auxiliary fiber opening and purifying system is regulated for the type and quality of fibers the opening cylinder is to process.

7. The flat carding machine of claim 1, wherein feeding means includes a physically separate supply of fibers for each of the opening cylinders.

8. The flat carding machine of claim 1, wherein feeding means includes a single supply of fibers having a separate discharge location for each of the opening cylinders.

* * * * *